US006364693B1

(12) United States Patent
Stagg et al.

(10) Patent No.: US 6,364,693 B1
(45) Date of Patent: Apr. 2, 2002

(54) BACKSHELL WITH FORCED ELECTRICAL CONNECTOR ORIENTATION

(75) Inventors: Michael E. Stagg, Huntington, IN (US); Gregory S. Didier, Coldwater, MI (US); Mark J. Braun, Fort Wayne, IN (US)

(73) Assignee: International Truck and Engine Corp., Warrenville, IL (US)

( * ) Notice: Subject to any disclaimer, the term of this patent is extended or adjusted under 35 U.S.C. 154(b) by 0 days.

(21) Appl. No.: 09/542,195

(22) Filed: Apr. 4, 2000

Related U.S. Application Data

(60) Provisional application No. 60/135,371, filed on May 21, 1999.

(51) Int. Cl.[7] ..... H01R 13/58
(52) U.S. Cl. ..... 439/467; 439/466
(58) Field of Search ..... 439/696, 687, 439/465–67, 468, 473

(56) References Cited

U.S. PATENT DOCUMENTS 3,920,306 A * 11/1975 Barnett, Jr. et al. ..... 339/103 M
5,444,182 A * 8/1995 Hoshino ..... 174/52.1
6,203,362 B1 * 3/2001 Tsuji ..... 439/470

* cited by examiner

*Primary Examiner*—P. Austin Bradley
*Assistant Examiner*—Ann McCamey
(74) *Attorney, Agent, or Firm*—Jeffrey P. Calfa; Dennis Kelly Sullivan; Neil T. Powell

(57) ABSTRACT

A backshell for an electrical connector gives the electrical connector handedness to force a particular orientation of the connector with respect to a device in order to limit the choice of devices to which the electrical connector can be attached. The backshell fits around the connector and a portion of a cable connected to the connector. The cable is forced into a right angle turn in the interior of the backshell to give the device handedness.

14 Claims, 5 Drawing Sheets

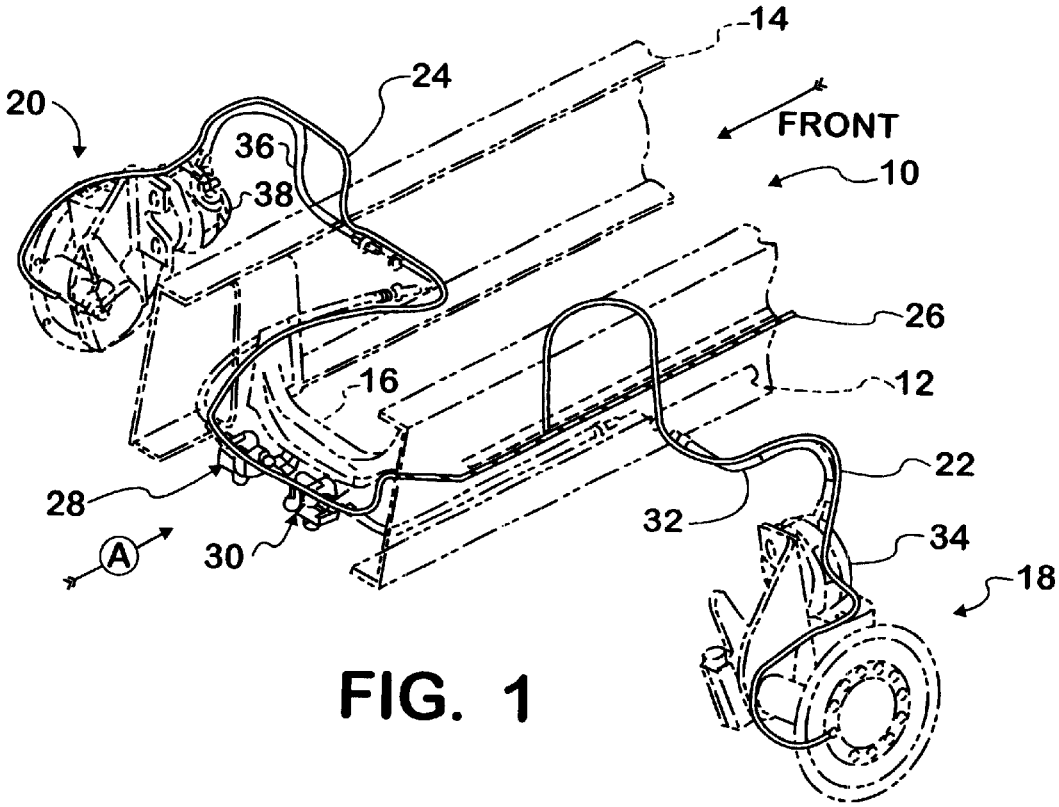
FIG. 1
FIG. 2
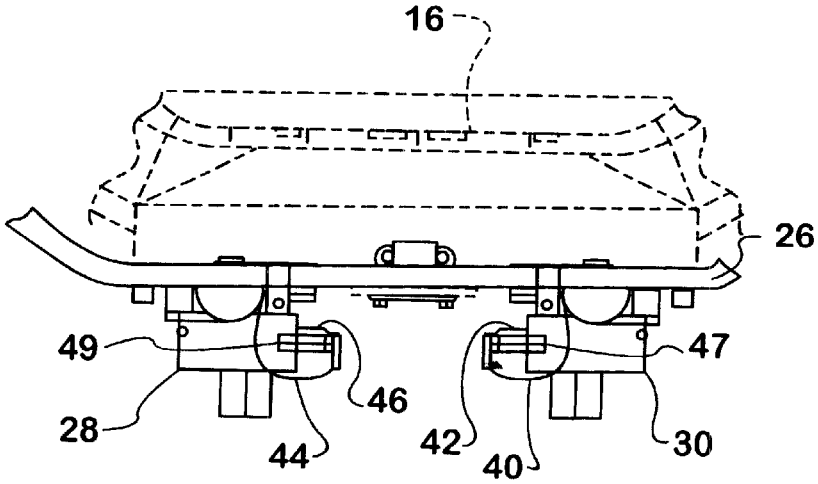

BACKSHELL WITH FORCED ELECTRICAL CONNECTOR ORIENTATION

RELATED APPLICATION

This application claims the benefit of U.S. Provisional Application No. 60/135,371 filed May 21, 1999, which application is incorporated herein in its entirety.

BACKGROUND OF THE INVENTION

1. Field of the Invention

The invention relates to an electrical connector assemblies for cables in motor vehicle electrical harnesses and more particularly to a backshell for fitting to end electrical connector for a cable which forces a preferred orientation of the electrical connector assembly relative to a device before connection can be made.

2. Description of the Prior Art

Harness and electrical cable connector assemblies are well known in the art. A motor vehicle electrical harness provides routing for electrical cables which transmit electrical power and control signals to diverse electrical and electronic devices positioned on a motor vehicle. Individual branches of the harness bundle cables and wires which service components in adjacent sections of a vehicle. A harness includes several large diameter cables enclosing smaller cables and wires inside a sheath. The sheath is typically constructed by winding a tape in a spiral fashion. Wires and cables in a harness are cut to predetermined lengths during manufacture of the harness and the ends of the wires and cables project from under the sheath at appropriate locations for connection to devices. During vehicle assembly workers can lay the harness along a predetermined path on the vehicle and the ends of the appropriate wires and cables to connect to vehicle accessories will automatically be positioned for attachment to devices. This saves considerable time during assembly and reduces the risk of connecting wires and cables to the wrong devices.

While the risk of incorrect connection of cables to devices is reduced by precutting the length of wires and cables, it is not eliminated in all cases. Wires and cables for automotive, and other applications, are typically terminated in a standardized connector, suitable for plug attachment to motors, sensors, switches and other devices. The Packard Electric Systems Division of Delphi Automotive Systems in Warren, Ohio, supplies the Metri-Pack connection systems, a family including at least five series of standardized terminators, designed to assure good seating and force correct orientation of the connector to device terminal.

Unfortunately, more than one device taking identical connectors may be in close proximity to one another on a vehicle, raising the possibility that two cables having identical connectors may emerge from a harness cord in close proximity to one another. Such an error would be easy to detect were, for example, control cables for a brake actuator and a vehicle horn crossed. Upon first depression of the brake pedal the horn would then sound. More serious, and more likely to occur, is the possibility that control cables leading to devices having similar functions might be crossed.

For example, in an anti-lock braking system (ABS) each brake is independently actuated in response to detection of skidding by the wheel associated with that brake. Brake actuation is controlled by a brake modulator valve. Due to space constraints and the lack of suitable mounting locations for the modulator valve, the valves for wheels on each end of a given axle, particularly the front steering axle, are often located in close physical proximity to one another. The electrical connecting cables for the modulators will then emerge from the harness in close physical proximity to one another, allowing the assembly worker or repair technician to cross the leads, which appear identical to one another. If the leads are crossed, indication of a skidding right wheel produces braking modulation for the left wheel and indication of a skidding left wheel produces braking modulation for the right wheel. The results can be difficult to detect in the field and, in an emergency, adverse to control of the vehicle.

SUMMARY OF THE INVENTION

The invention provides an electrical connector including an electrical cable connected to a terminal connector. The terminal connector is fabricated from a thermoplastic body and has an orientation guide on an exterior surface, A backshell is provided for fitting around the terminal connector and a portion of the cable adjacent to the terminal connector, The backshell comprises a first halfshell and a second halfshell connected on a hinge. The first and second halfshells form, when closed on one another, an interior channel accessible from the outside at two ends for receiving the electrical cable and the terminal connector, respectively. The first and second halfshells form, at the end for receiving the electrical cable, an opening shaped to fit around the cable circumference and further form, at the end for receiving the terminal connector, an opening shaped to fit around the terminal connector. The portion of the opening formed by the first halfshell fits around the orientation guide to force the backshell to assume a particular orientation on the terminal connector and electrical cable. The interior channel defines a turn, which combined with the forced orientation of the backshell, gives the electrical connector handedness. Depending on the direction of the turn, the electrical connector exhibits right or left handedness. Handedness prevents the wire or cable from being twisted to correctly orient the terminal connector to the device and still reach an Incorrect device accepting the terminal connector type.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a perspective view a section of a vehicle frame and front wheel skid monitoring system;

FIG. 2 is a front elevation of the vehicle frame of FIG. 1 viewed from the direction of letter "A";

DETAILED DESCRIPTION OF THE INVENTION

Figure 3A:
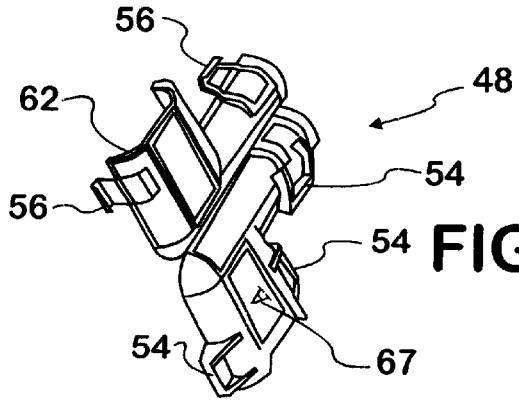
FIG. 3A is a perspective view of an opened backshell in conformance with the present invention.

Referring now to the figures and in particular to FIG. 1, a preferred embodiment of the invention and its use will be described. In FIG. 1 a motor vehicle frame 10 includes left side and right side frame rails 12 and 14. Frame rails 12 and 14 are held parallel to one another by a cross member 16 which is located substantially adjacent the front end (indicated by the letter "A") of frame 10. Outboard from frame rails 12 and 14 are a left side wheel speed sensor assembly 18 and a right side wheel speed sensor assembly 20, respectively. Each of wheel speed sensor assemblies 18 and 20 is connected to an onboard computer (not shown) by monitor wires, 22 and 24, respectively, which emerge from harness 26 along the left and right frame rails 12 and 14. Left and right side wheel speed sensor assemblies 18 and 20 are components in a antilock braking system (ABS) used to detect wheel skidding. Anti-lock braking systems provide modulation of braking action in response to skid detection.

Brake action modulation is provided by a right side ABS modulator valve 30 and a left side ABS modulator valve 28, both of which are electrically actuated. ABS modulator valves 30 and 28 are located on cross member 16 at the front of the vehicle. The ABS modulator valves 30 and 28 are connected to brake actuators 34 and 38, respectively, by pressure lines 32 and 36, which in turn deliver hydraulic fluid to and from the actuators at pressures controlled by the ABS modulator valves.

FIG. 2 further illustrates the positioning of ABS modulator valves 30 and 28 and the connection of the valves to the vehicle electrical harness 26, which is representative of a common configuration found on trucks. Harness 26 is positioned along cross member 16 passing above ABS modulator valves 30 and 28. Electrical attachment from harness 26 to ABS modulator valves 30 and 28 is had by cables emerging from harness 26, sections 40 and 44 of which are visible. Cable section 40 is connected to an electrical connector 42 which in turn plugs into a suitable mating slot 47 on ABS modulator valve 30. Cable section 44 connects to a electrical connector 46 which in turn plugs into a mating slot 49 on ABS modulator valve 28.

Figure 3B:
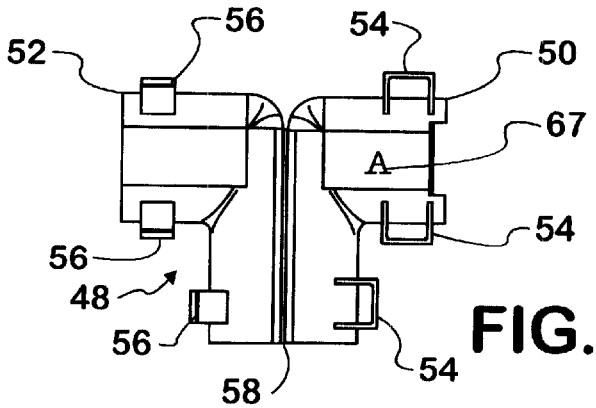
FIG. 3B is a top plan view of an opened backshell in conformance with the present invention.
Figure 3C:
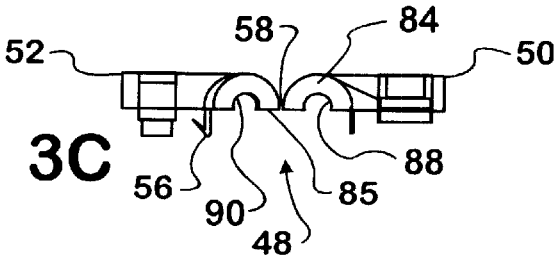
FIG. 3C is a side elevation of an opened backshell in conformance with the present 30 invention.

FIGS. 3A–C illustrate an embodiment of a backshell 48 used to construct an electrical connector assembly 42. Backshells, in accordance with the invention, can be applied around the junction of a cable and terminal connector to give the assembly of backshell, cable and terminal connector left handedness or right handedness. The designation of a particular assembly as left handed or right handed is arbitrary, indicating mirror image configurations of otherwise identical devices. In a preferred application, right handedness will be applied to a electrical connector assembly 42 intended for use with an ABS brake modulator 30 installed on the front end of the right side of a vehicle as viewed from the front. In other words, the driver's side of the vehicle for conventional North American and continental European motor vehicles. Right handedness is indicated on an exterior surface of half backshell 50 by the indicia "A" 67. It should be understood that a right handed electrical connector assembly 42 may be installed on the opposite vehicle side for wheels towards the rear of the vehicle.

Backshell 48 is preferably molded from a heat and oil resistant thermoplastic. Backshell 48 comprises two half backshells 50 and 52. Top and bottom half backshells 50 and 52 are linked along adjoining major edges by a hinge 58, on which the half backshells can be folded together. Reference to the half backshells as being "top" and "bottom" is by arbitrary convention. When folded together the half backshells 50 and 52 snap together by the interaction of a plurality of catches 54 and spring loaded latch bars 56 spaced along the unhinged edges of the half backshells. Spring loaded latch bars 56 are "J" shaped appendages arranged vertically along the edges of bottom half backshell 52 to engage latches 54 located symmetrically to the latch bars 56 along the edges of top half backshell 50. Backshell 48 is opened at ends canted 90 degrees from one another to admit an electrical cable 40 and a terminal connector 47. An opening for a cable, for example, is defined by semicircular openings 88 and 90 in end wall 84 and 85, respectively.

Figure 4A:
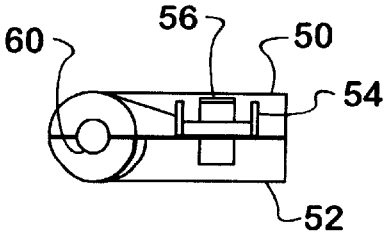
FIGS. 4A–B are end views showing the cable and terminal connector openings, respectively, formed by a closed backshell.
Figure 4B:
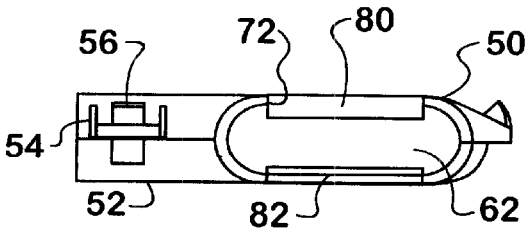

FIGS. 4A–B illustrate a backshell 48 formed upon closure of top and bottom half backshells 50 and 52, and more particularly, openings 60 and 62 which are formed to admit and retain a cable and an electrical terminator, respectively. Opening 60 is a circular opening which fits snugly around the circumference of a cable. Opening 62 has a substantially rectangular section, closed at each end by semi-circular walls. A notch 72 is formed inwardly from the edge of top half backshell 50 until it abuts a retaining ridge 80. A similar retaining ridge 82 is formed parallel to ridge 80, recessed from the outer edge of the bottom half backshell 52.

Figure 5A:
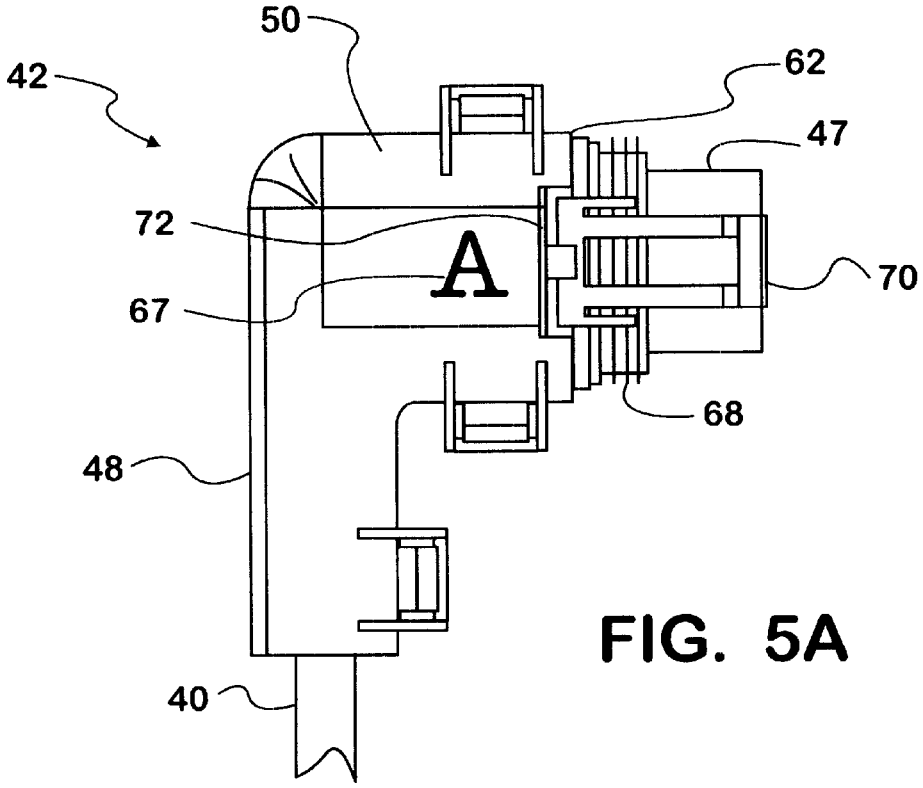
FIGS. 5A–B are top and bottom plan views of a right handed electrical connector of the present invention.
Figure 5B:
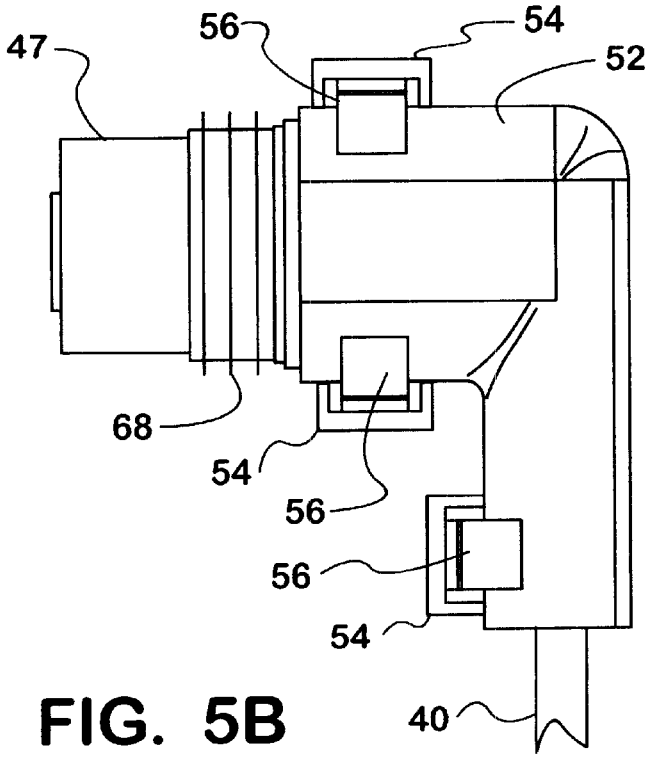

FIGS. 5A–B illustrate a right handed electrical connector 42, comprising a backshell 48, a section of cable 40 and terminal connector 47. Cable 40 extends from backshell 48 substantially perpendicular to and coplainer with terminal connector 47. Guide and connection assurance member 70 project outwardly from terminal connector 47 and aligned with notch 72. In order to position terminal connector 47 in opening 62, and align cooperating indentations in the connector with retaining members 80 and 82 (See FIG. 7), the guide and connection assurance member must be positioned in notch 72, which forces a particular orientation of terminal connector 47 in opening 62. On insertion of electrical connector 42 into a cooperating female connecting slot, circumferential sealing lips 68 help seal the connection against the infiltration of dust and oil.

Figure 6A:
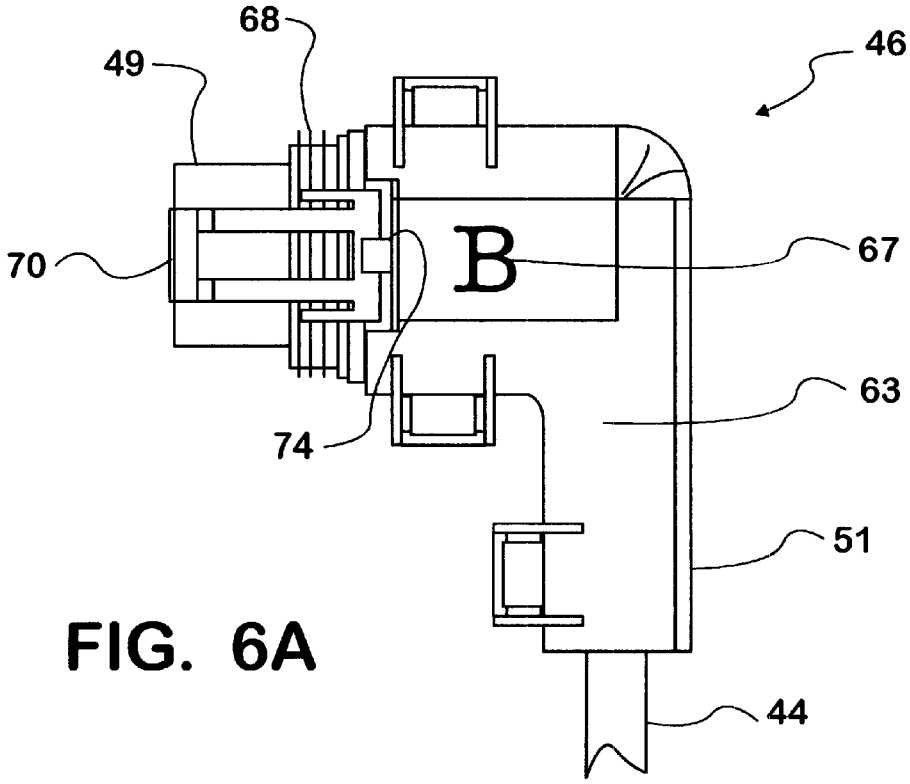
FIGS. 6A–B are top and bottom plan views of a left handed electrical connector of the present invention.
Figure 6B:
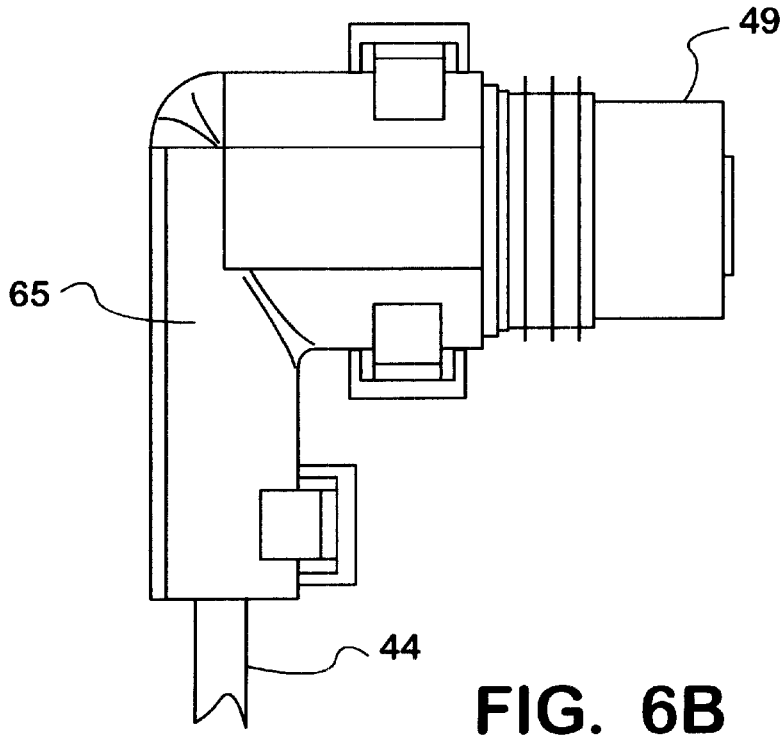

FIGS. 6A–B illustrate a left handed electrical connector 46, comprising a backshell 51, a section of cable 44 and terminal connector 49. Left handedness is indicated by the symbol "B" 67 on the exterior surface of top half backshell 63. Terminal connector 49 is physically identical to terminal connector 47 of FIG. 5. Cable 44 extends from backshell 51 substantially perpendicular to and coplainer with terminal connector 49. Guide and connection assurance member 70 project outwardly from terminal connector 49 and aligned with notch 74. In order to position terminal connector 49 in the opening from backshell, the guide and connection assurance member 70 must be positioned in notch 74, which forces a particular orientation of terminal connector 49, mirroring that obtained for the right handed electrical connector 42.

Figure 7:
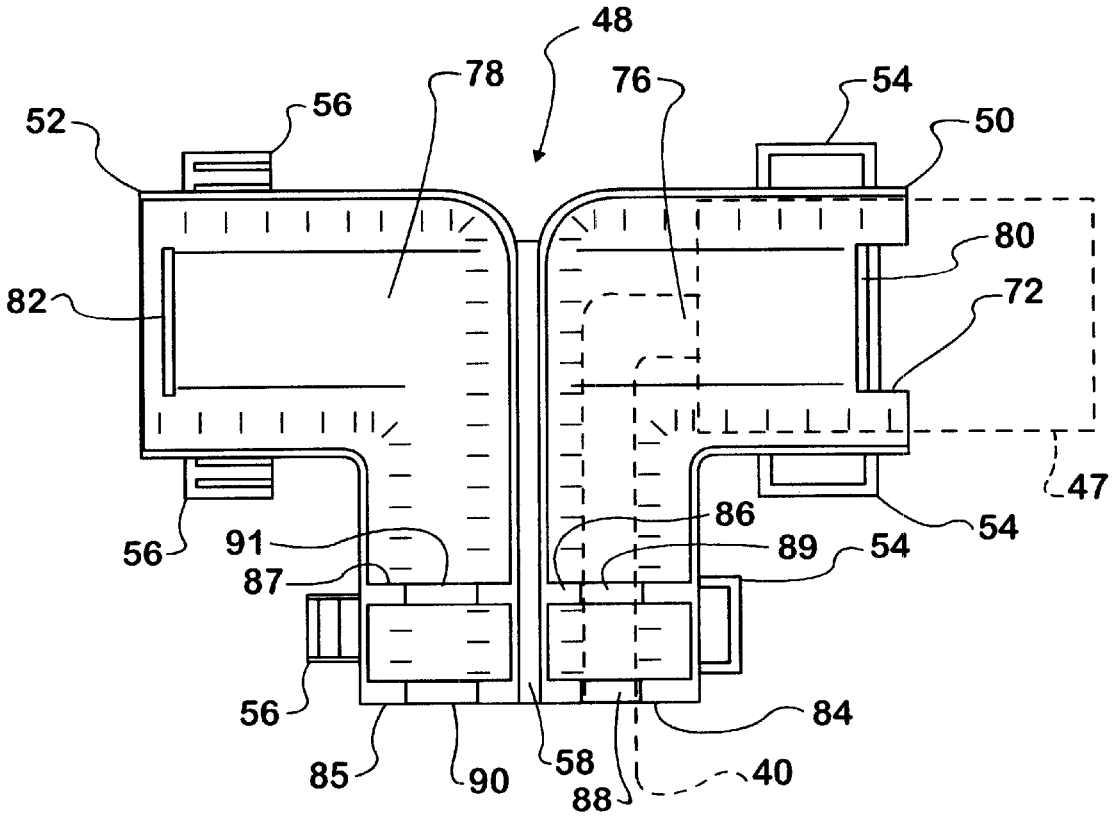
FIG. 7 is a plan view of an opened backshell.

FIG. 7 an interior channel defined by half backshells 50 and 52 for right handed backshell 48. Upon folding of the half backshells 50 and 52, an interior channel is defined by recessed interior surfaces 76 and 78, respectively, of half backshells 50 and 52. Retaining members 80 and 82 extend inwardly from the recessed interior surfaces 76 and 78. Retaining member 80 defines, along one edge, the rearward edge of notch 72. A cable inserted in backshell 48 is held in two annular openings, defined by semicircular notches 88, 89, 90 and 91, which are set in end walls 84, 86, 85 and 87, respectively. The interior channel defined by halfshells 50 and 52 forces a right turn in the cable, or individual wires extending from the cable, before attachment to a terminal connector.

Utilizing the present invention, otherwise identical electrical connectors, particularly those in close proximity to one another on a motor vehicle, may be differentiated by converting the connectors into mirror images of each other. Doing so reduces the danger of misconnection of the connectors to receptacles, particularly by field technicians working on an unfamiliar vehicle.

While the invention is shown in only one of its forms, it is not thus limited but is susceptible to various changes and modifications without departing from the spirit and scope of the invention.

What is claimed is:

1. A backshell for a terminal connector and a cable section connected to the terminal connector where the terminal connector has exterior features defining an orientation with respect to a mating connector, the backshell comprising:

an interior channel through the backshell, the interior channel having a first opening through the backshell shaped to admit the cable section and a second opening through the backshell shaped to fit around the terminal connector and to cooperate with the exterior features of the terminal connector so that the second opening and the backshell fit around the terminal connector in only one orientation; and the interior channel forcing a substantially right angle turn in the cable to give an assembly formed by the backshell, terminal and cable section predetermined handedness.

2. A backshell as claimed in claim 1, further comprising:

a first halfshell having an interior surface defining a longitudinal section of the interior channel and further defined by an edge which, in part, forms a portion of the first opening for the cable section and a portion of the second opening fitting around at least a portion of the exterior features of the terminal connector; and a second halfshell having an interior surface defining a longitudinal section of the interior channel and further defined by an edge which, in part, forms a portion of the first opening of the cable section and a portion of the second opening.

3. A backshell as claimed in claim 2, wherein the substantially right angle turn in the cable section gives the assembly right handedness.

4. A backshell as claimed in claim 3, wherein the substantially right angle turn in the cable section gives the assembly left handedness.

5. A connector assembly for electric circuit terminals, comprising:

a cable;

a terminal connector attached to an end of the cable, the terminal connector having opposed major upper and lower surfaces, the major upper and lower surfaces defining an orientation for the terminal connector relative to an mating connector;

a backshell comprising a first half shell and a second half shell, the half shells being hinged to close on one another for defining an interior channel within the backshell;

a substantially right angle turn in the interior channel;

the interior channel having openings at each end from the backshell, one of said openings providing admittance to the cable and the second opening fitting around the terminal connector; and the half backshells be shaped along an edge forming the second opening to force a single orientation of the backshell on the terminal connector with the connector assembly exhibiting a predetermined handedness.

6. A connector assembly as claimed in claim 5, further comprising:

a guide member depending from the major upper surface of the connector terminal defining its orientation; and cooperating latch and catch assemblies depending from the half backshells.

7. A connector assembly as claimed in claim 6, wherein the substantially right angle turn in the interior channel gives the connector assembly handedness.

8. A connector assembly as claimed in claim 7, exhibiting right handedness.

9. A connector assembly as claimed in claim 8, exhibiting left handedness.

10. An electrical connector comprising:

an electrical cable having an end;

a terminal connector attached to the end of the electrical cable, the terminal connector including a thermoplastic body having an orientation guide on an exterior surface thereof;

a backshell comprising a first halfshell and a second halfshell connected by a hinge, the first and second halfshells forming, when closed on one another, an interior channel accessible from outside the backshell through two openings for receiving the electrical cable and the terminal connector, respectively;

the first and second halfshells forming when closed an opening for receiving the electrical cable shaped to fit around the cable circumference and further forming a second opening for receiving the terminal connector, the second opening being shaped to fit around the terminal connector in only one orientation, with a portion of the second opening formed by the first halfshell fitting around the orientation guide to force the orientation of the backshell on the terminal connector and electrical cable; and the interior channel defining a turn giving the electrical connector a predetermined handedness.

11. An electrical connector as claimed in claim 10, wherein the electrical connector exhibits right handedness.

12. An electrical connector as claimed in claim 11, wherein the electrical connector exhibits left handedness.

13. A vehicle electrical system comprising:

a plurality of devices attached to a vehicle having electrical connection sockets of one of a limited number of types, the electrical connection socket being unidirectional;

an electrical harness including a plurality of electrical cables, each cable being cut to a length required to reach a particular device;

terminal connectors attached to ends of electrical cables and matched to fit the electrical connection socket for the device, each terminal connector having exterior surface features cooperating with the electrical connector socket to permit insertion of the terminal connector in only one orientation;

backshells fitted to selected terminal connector and cable end section pairs, each backshell comprising a first halfshell and a second halfshell connected by a hinge, the first and second halfshells forming, when closed on one another, an interior channel passing through the backshell between two exterior openings, one of which exterior openings fits around the circumference of the cable and the second of which exterior openings fits around the terminal connector;

the second exterior opening being shaped to cooperate with the exterior features of the terminal connector defining orientation to force fitting of the backshell to the terminal connector and electrical cable end in only one direction; and the interior channel defining a turn giving the assembly of the terminal connector, backshell and electrical cable end a predetermined handedness.

14. A vehicle electrical system as claimed in claim 13, further comprising:

pairs of proximately located devices having electrical connectors of the same type; and backshells assembled on the terminal connectors for the proximately located pairs of devices giving the assemblies opposed handedness.

* * * * *